US012139689B2

(12) United States Patent
Schimmel et al.

(10) Patent No.: US 12,139,689 B2
(45) Date of Patent: Nov. 12, 2024

(54) COMPRESSOR OILS WITH HIGH VISCOSITY INDEX

(71) Applicant: Evonik Operations GmbH, Essen (DE)

(72) Inventors: Thomas Schimmel, Shanghai (CN); Frank-Olaf Mähling, Mannheim (DE); Lucas Voigt, Weiterstadt (DE)

(73) Assignee: Evonik Operations GmbH, Essen (DE)

( * ) Notice: Subject to any disclaimer, the term of this patent is extended or adjusted under 35 U.S.C. 154(b) by 0 days.

(21) Appl. No.: 18/253,279

(22) PCT Filed: Nov. 18, 2021

(86) PCT No.: PCT/EP2021/082100
§ 371 (c)(1),
(2) Date: May 17, 2023

(87) PCT Pub. No.: WO2022/106519
PCT Pub. Date: May 27, 2022

(65) Prior Publication Data

US 2023/0416634 A1 Dec. 28, 2023

(30) Foreign Application Priority Data

Nov. 18, 2020 (EP) ..... 20208466

(51) Int. Cl.
*C10M 171/00* (2006.01)
*C10N 20/00* (2006.01)
(Continued)

(52) U.S. Cl.
CPC .. *C10M 171/008* (2013.01); *C10M 2209/084* (2013.01); *C10N 2020/02* (2013.01);
(Continued)

(58) Field of Classification Search
CPC ..... C10M 171/008; C10M 2209/084; C10M 2205/028; C10M 2203/1006;
(Continued)

(56) References Cited

U.S. PATENT DOCUMENTS 6,599,864 B1 7/2003 Bertomeu
2009/0062167 A1 3/2009 Kaneko
(Continued)

FOREIGN PATENT DOCUMENTS

CN 105247026 A * 1/2016 ..... C10M 129/70
CN 107304380 A * 10/2017 ..... C07D 285/125
(Continued)

OTHER PUBLICATIONS

International Search Report dated Jan. 19, 2022, in PCT/EP2021/082100, 5 pages.
(Continued)

*Primary Examiner* — Taiwo Oladapo
(74) *Attorney, Agent, or Firm* — Grüneberg and Myers PLLC

(57) ABSTRACT

Polyalkyl (meth)acrylates are useful in compressor oils. A method of increasing the energy efficiency of a compressor involves operating the compressor with a compressor oil containing a polyalkyl (meth)acrylate-based viscosity index improver.

14 Claims, 1 Drawing Sheet

Illustration of the test settings used to determine the effects on energy consumption in an air compressor.

(51) Int. Cl.

| | |
|---|---|
| *C10N 20/02* | (2006.01) |
| *C10N 20/04* | (2006.01) |
| *C10N 30/02* | (2006.01) |
| *C10N 40/30* | (2006.01) |

(52) U.S. Cl.
CPC .... *C10N 2020/04* (2013.01); *C10N 2020/106* (2020.05); *C10N 2030/02* (2013.01); *C10N 2040/30* (2013.01)

(58) Field of Classification Search
CPC ..... C10N 2020/02; C10N 2020/04; C10N 2020/106; C10N 2030/02; C10N 2040/30
See application file for complete search history.

(56) References Cited

U.S. PATENT DOCUMENTS

| | | | | |
|---|---|---|---|---|
| 2009/0181871 | A1 | 7/2009 | Shah et al. | |
| 2016/0046885 | A1* | 2/2016 | Cosimbescu | C10M 145/22 525/327.3 |
| 2017/0218295 | A1 | 8/2017 | Lauterwasser et al. | |
| 2018/0230397 | A1* | 8/2018 | Nakano | C09K 5/04 |
| 2019/0241827 | A1* | 8/2019 | Kaneko | C09K 5/042 |

FOREIGN PATENT DOCUMENTS

| | | |
|---|---|---|
| EP | 0 668 342 | 8/1995 |
| EP | 0 776 959 | 6/1997 |
| EP | 1 029 029 | 8/2000 |
| EP | 1 987 118 | 11/2008 |
| EP | 2 337 832 | 6/2011 |
| JP | 2000044978 A * | 2/2000 |
| WO | 96/30421 | 10/1996 |
| WO | 97/18247 | 5/1997 |
| WO | 97/21788 | 6/1997 |
| WO | 97/47661 | 12/1997 |
| WO | 98/01478 | 1/1998 |
| WO | 98/40415 | 9/1998 |
| WO | 99/10387 | 3/1999 |
| WO | 99/20720 | 4/1999 |
| WO | 99/41332 | 8/1999 |
| WO | 00/08115 | 2/2000 |
| WO | 00/14179 | 3/2000 |
| WO | 00/14183 | 3/2000 |
| WO | 00/14187 | 3/2000 |
| WO | 00/14188 | 3/2000 |
| WO | 00/15736 | 3/2000 |
| WO | 01/18156 | 3/2001 |
| WO | 01/57166 | 8/2001 |
| WO | 2007/096011 | 8/2007 |
| WO | 2010/043503 | 4/2010 |
| WO | 2013/189951 | 12/2013 |

OTHER PUBLICATIONS

Mang et al., "Lubricants and Lubrication", Wiley-VCH, Weinheim 2001, 2001, 3 pages.
Mortier et al., "Chemistry and Technology of Lubricants", Springer Science + Business Media LLC, 1992, 3 pages.
Wang et al., "Controlled/"Living" Radical Polymerization. Halogen Atom Transfer Radical Polymerization Promoted by a Cu(I)/Cu(II) Redox Process", Macromolecules, vol. 28, 1995, pp. 7901-7910.
Wang et al., "Controlled/"Living" Radical Polymerization. Atom Transfer Radical Polymerization in the Presence of Transition-Metal Complexes", Journal of American Chemical Society, vol. 117, 1995, pp. 5614-5615.
Written Opinion dated Jan. 19, 2022, in PCT/EP2021/082100, 10 pages.

* cited by examiner

Illustration of the test settings used to determine the effects on energy consumption in an air compressor.
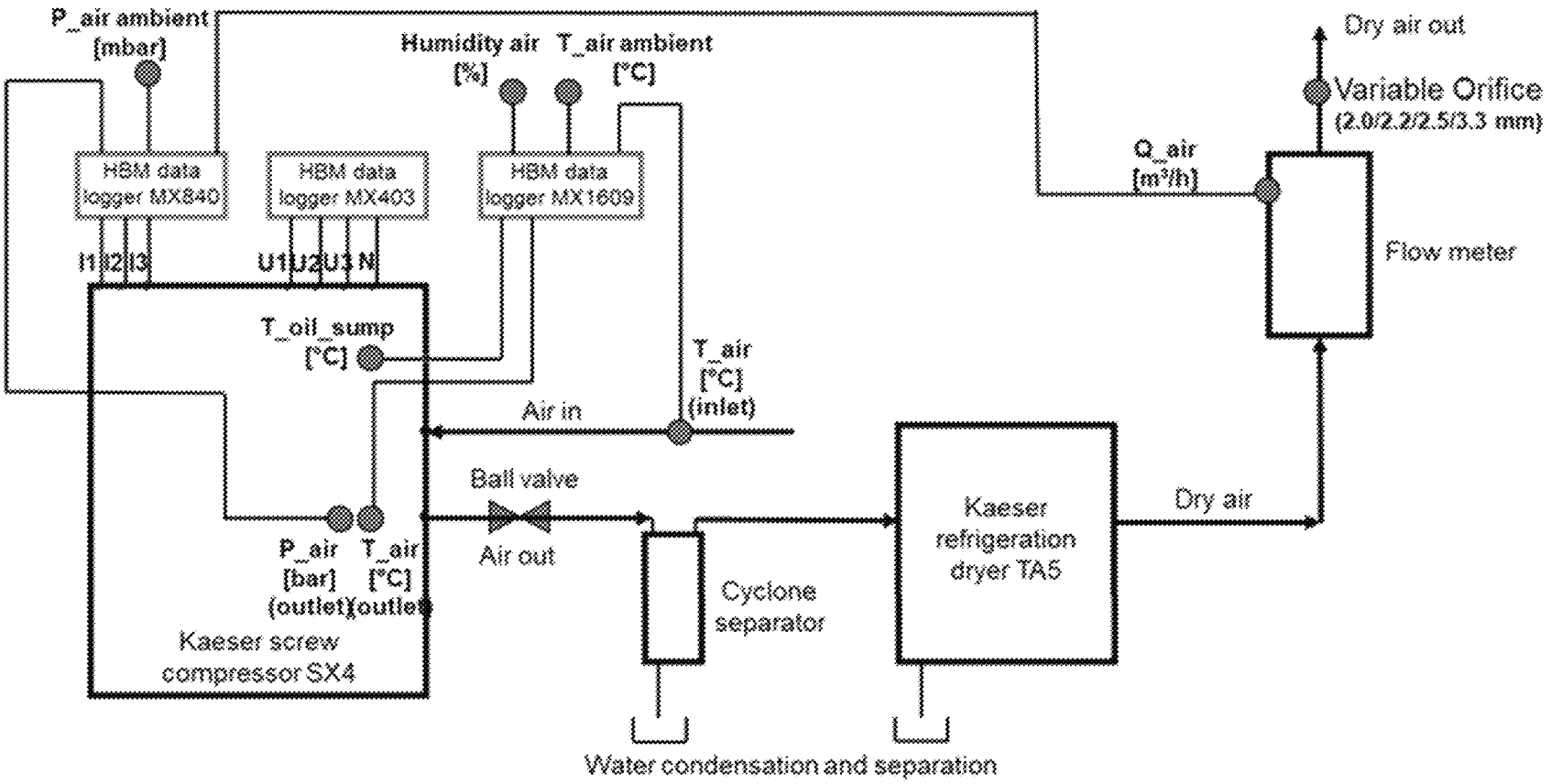

COMPRESSOR OILS WITH HIGH VISCOSITY INDEX

CROSS-REFERENCE TO RELATED APPLICATIONS

This application is the National Stage entry under § 371 of International Application No. PCT/EP2021/082100, filed on Nov. 18, 2021, and which claims the benefit of priority to European Application No. 20208466.1, filed on Nov. 18, 2020. The content of each of these applications is hereby incorporated by reference in its entirety.

BACKGROUND OF THE INVENTION

Field of the Invention

The present invention is directed to the use of polyalkyl (meth)acrylates in compressor oils. It is especially directed to a method of increasing the energy efficiency of a compressor by operating the compressor with a compressor oil comprising a polyalkyl (meth)acrylate-based viscosity index improver.

Description of Related Art

Common compressors belong to the groups of rotating or reciprocating machines. They compress a variety of gases, e.g. air, carbon dioxide or other refrigerants. Small refrigeration compressors are used in domestic refrigerators, larger compressors are used to cool warehouses.

The call for sustainability and a reduction of global warming impact makes low energy consumption and high efficiency inevitable for a state-of-the-art compressor technology. As the domestic refrigerator is a globally widespread product and used in millions of households, the potential of saving energy is immense. The same is true for compressed air that is used in nearly all industries as well as in pneumatic systems in commercial and industrial sectors.

The most common refrigeration cycle is accomplished by circulating, evaporating, and condensing the refrigerant in a closed system. Evaporation occurs at low temperature and low pressure while condensation occurs at high temperature and high pressure. This makes it possible to transfer heat from an area of low temperature to an area of high temperature.

The important internal parts of the refrigerator are refrigerant, compressor, condenser, expansive valve or the capillary and evaporator, chiller or freezer.

The refrigerant flows through all the internal parts of the refrigerator. It carries out the cooling effect in the evaporator. It absorbs the heat from the substance to be cooled in the evaporator (chiller or freezer) and throws it to the atmosphere via condenser. The refrigerant keeps on recirculating through all the internal parts of the refrigerator cycle. The compressor sucks the refrigerant from the evaporator and discharges it at high pressure and temperature. The compressor is driven by the electric motor and it is the major power consuming device of the refrigerator. The refrigerant from the compressor enters the condenser where it is cooled by the atmospheric air thus losing heat absorbed by it in the evaporator and the compressor. The refrigerant leaving the condenser enters the expansion devise. When the refrigerant is passed through the capillary its pressure and temperature drop down suddenly. The refrigerant at very low pressure and temperature enters the evaporator or the freezer. The evaporator is the heat exchanger. The refrigerant absorbs the heat from the substance to be cooled in the evaporator, gets evaporated and it then sucked by the compressor. This cycle keeps on repeating.

Within a refrigeration cycle, the compressor is the most sensitive component that must be property lubricated in order to achieve a long service life. Lubricants for refrigeration compressors reduce friction, prevent wear and act as a seal between the high- and low-pressure sides.

Refrigerators have a structure in which a mixture of a refrigerant and a compressor oil is circulated within a closed system. It is therefore further required that the compressor oil has a high compatibility with the refrigerant. Apart from that, further challenges of a compressor oil are good sealing properties as well as wear protection and corrosion protection of the compressor unit.

The domestic refrigerator uses isobutane (R600a) as refrigerant what is considered as a modern and proven state of the art. However, the research on the topic of efficiency enhancement mainly focusses on the refrigerant and the compressor itself, because it is the main energy-consuming component in the refrigeration cycle. The compressor is lubricated and, consequently, the lubricant is one of the determining factors within the compressor affecting the total efficiency. Besides the compatibility of the chemical components of the lubricant and the refrigerant, the resulting compressor performance is important.

In the field of lubricants and lubrication technology, compressor oils are of particular importance. The long lifetime expectations of refrigerant compressors are closely related to the high-quality requirements of the lubricants.

In addition to the favorable miscibility characteristics with the corresponding refrigerant, good cold flow properties, high aging resistance and high chemical and thermal stability play an important role.

The interaction with other substances, especially the refrigerant, requires in the refrigeration cycle at partly extreme temperature differences very specific demands and a wide temperature operating window of the lubricant.

In the field of refrigerator systems, the demand for energy saving is high. One starting point to improve the energy efficiency is the use of a refrigerator oil with low viscosity, i.e. with low viscosity grades. Common standard for compressor oils using isobutane as refrigerant is an ISO viscosity grade (ISO VG) of 7, sometimes also ISO VG 5. But a further reduction of viscosity would be desired.

The challenges that come along with thinner base fluids are that the compatibility of the oil with the refrigerant, i.e. solubility of refrigerant in the oil, the sealing performance, as well as wear and corrosion protection have to be ensured.

In case the lubrication of the compressor is insufficient, it results in an increased power consumption, reduced overall efficiency or emission of heat accompanied by a temperature rise and reduced lifetime of the oil and the equipment. The suitability of an oil can be tested on a standardized test rig for small-capacity refrigerant compressors that assures comparable test parameters, measures the refrigerant mass flow rate, the compressor power consumption and calorimeter heat input as well as the compressor shell temperature.

Additives are well known in the lubricant industry to be able to deliver performance benefits, like e.g. wear and corrosion protection, improved oxidation stability or to cure sealing problems.

Commonly used are inter alia polyalkyl (meth)acrylates. Polyalkyl (meth)acrylates are well-known additives that are used in different applications like engine oils, transmission oils, gear oils, hydraulic oils, greases and metalworking fluids.

The use of polyalkyl (meth)acrylates as viscosity index improvers in compressor oils has so far not been reported.

STATE OF THE ART

US 2009/0062167 is directed to a refrigerating machine oil composition comprising a mixed base oil which is composed of a low-viscosity base oil and a high-viscosity base oil. The presence of a polyalkyl (meth)acrylate-based viscosity index improver according to the present invention is not disclosed and energy savings are not reported.

US 2019/0241827 relates to a refrigerator oil, containing a specific mineral oil (A) and at least one polymer (B), that is excellent in lubricity. The presence of a polyalkyl (meth) acrylate-based viscosity index improver according to the present invention is not disclosed and energy savings are not reported.

EP 2337832 discloses a method of reducing noise generation in a hydraulic system, comprising contacting a hydraulic fluid comprising a polyalkyl(meth)acrylate polymer with the hydraulic system.

The hydraulic fluid contains a viscosity index improver and has a Viscosity Index (VI) of at least 130. The VI improver is described as polyalkyl(meth)acrylate, has a molecular weight in the range of 10,000 to 200,000 g/mol and is obtained by polymerizing a mixture of olefinically unsaturated monomers, said mixture comprising preferably 50 to 95 wt. % C9 to C16 and 1 to 30 wt. % of C1 to C8 alkylmethacrylates.

Target of the invention described in EP 2337832 was the reduction of noise which is achieved by increasing oil viscosities at higher temperatures. For this effect, high viscosities and high densities are beneficial and the high VI of the fluids is responsible for increased viscosity at operating temperature.

In the present invention, a similar approach is used to increase the energy efficiency of a completely different system.

The difference between hydraulic systems and compressor (e.g. pneumatic) systems lies in the medium that is utilized to transmit the power. Pneumatics use easily compressible gas like air or other gas. Meanwhile, hydraulics utilize relatively-incompressible liquid media like mineral oil, ethylene glycol, water, synthetic types of oils, or high temperature fire-resistant fluids to make power transmission possible.

Because of this primary difference, some other aspects about these two power circuits also follow suit. Industrial applications of pneumatics utilize pressures ranging from 80 to 100 pounds per square-inch, while hydraulics use 1,000 to 7,500 psi, or even more than 10,000 psi for specialized applications.

Moreover, a tank would be needed in order to store the oil by which the hydraulic system can draw from in cases of a deficit. In a pneumatic system however, air can simply be drawn from the atmosphere then purified via a filter and dryer.

As pneumatics use compressible gas, they need a compressor. To the contrary, hydraulics use liquid inside systems that comprise pumps, valves and actuators.

The temperature ranges in compressors can be much wider than in hydraulic systems and air compressor oils need to resist the permanent exposure to hot air.

Performance additive packages of hydraulic oils traditionally contain metals and are ash-forming, while compressor oils are ashless.

EP 1987118 discloses the use of a fluid with a viscosity index of at least 130 for the use in hydraulic systems like engines or electric motors. This fluid comprises a copolymer of C1 to C6 (meth)acrylates, C7 to C40 (meth)acrylates and optionally further with (meth)acrylates copolymerizable monomers in a mixture of an API group II or III mineral oil and a polyalphaolefine with a molecular weight below 10,000 g/mol.

The difference between the technical field of hydraulic fluids and compressor fluids is the use of one fluid to lubricate and provide work in hydraulics and the use of two separately defined fluids in compressors. A common aspect is the widespread use in many applications and the need for efficiency improvement.

SUMMARY OF THE INVENTION

It was an object of the present invention to provide a compressor oil that leads to an increase in energy efficiency. Saving energy allows the use of smaller compressors that comes along with cheaper design and operation, i.e. a decrease in energy consumption at similar performance.

It was now surprisingly found that a compressor oil formulated with a polyalkyl methacrylate-based viscosity index improver as defined below allows a compressor operation with significantly reduced specific energy demand compared to the operation with a compressor oil not containing such polyalkyl methacrylate-based viscosity index improver.

BRIEF DESCRIPTION OF THE DRAWING

The FIGURE shows the test settings used to determine the effects on energy consumption in an air compressor.

DETAILED DESCRIPTION OF THE INVENTION

An object of the present invention is directed to a method of increasing the energy efficiency of a compressor, comprising operating a compressor with a compressor oil, characterized in that the compressor oil comprises:

(i) 1 wt. % to 30 wt. % of a polyalkyl methacrylate-based viscosity index improver comprising:
  (a) 0 wt. % to 25 wt. % of methyl methacrylate;
  (b) 75 wt. % to 100 wt. % of straight-chained or branched C10-18 alkyl (meth)acrylates; and
  (c) 0 wt. % to 2 wt. % of straight-chained or branched C5-9 alkyl (meth)acrylates or straight-chained or branched C20-24 alkyl (meth)acrylates, wherein the weight average molecular weight ($M_w$) of the polyalkyl (meth)acrylate-based viscosity index improver is in the range of 5,000 to 400,000 g/mol;

(ii) 70 wt. % to 99 wt. % of a base oil selected from API group II, III, IV and V and mixtures thereof, and (iii) 0 wt. % to 2.5 wt. % of a zinc-free performance package comprising at least an antiwear agent, an anticorrosion agent and an antioxidant, wherein the compressor oil has a viscosity index of at least 140, preferably at least 160, more preferably at least 180.

In a further object, the compressor oil comprises:

(i) 1 wt. % to 20 wt. %, preferably 1 wt. % to 15 wt. %, preferably 1 wt. % to 10 wt. %, of a polyalkyl methacrylate-based viscosity index improver as outlined further above;

(ii) 80 wt. % to 99 wt. %, preferably 85 wt. % to 99 wt. %, preferably 90 wt. % to 99 wt. %, of a base oil selected from API group II, III, IV and V and mixtures thereof; and (iii) 0 wt. % to 2.5 wt. % of a zinc-free performance package comprising at least an antiwear agent, an anticorrosion agent and an antioxidant.

In a further object, the polyalkyl methacrylate-based viscosity index improver comprises:

(a) 0.2 wt. % to 25 wt. %, preferably 4 wt. % to 16 wt. %, of methyl methacrylate;

(b) 75 wt. % to 99.8 wt. %, preferably 84 wt. % to 96 wt. % of straight-chained or branched C10-18 alkyl methacrylates; and (c) 0 wt. % to 2 wt. % of straight-chained or branched C5-9 alkyl (meth)acrylates or straight-chained or branched C20-24 alkyl (meth)acrylates.

The content of each component (i), (ii) and (iii) is based on the total composition of the compressor oil. In a particular embodiment, the proportions of components (i), (ii) and (iii) add up to 100% by weight.

The content of each component (a), (b) and (c) is based on the total composition of the polyalkyl (meth)acrylate-based viscosity index improver. The proportions of components (a), (b) and (c) add up to 100% by weight.

The weight-average molecular weight $M_w$ of the polyalkyl acrylate polymers according to the present invention is preferably at least 5,000 g/mol or 8,000 g/mol or 10,000 g/mol or 30,000 g/mol and preferably at most 400,000 g/mol or 200,000 g/mol or 100,000 g/mol or 80,000 g/mol; for example in the range of 5,000 g/mol to 400,000 g/mol, preferably in the range of 5,000 g/mol to 200,000 g/mol or 5,000 g/mol to 100,000 g/mol or 8,000 g/mol to 100,000 g/mol or 10,000 g/mol to 200,000 g/mol or 30,000 g/mol to 100,000 g/mol or 10,000 g/mol to 80,000 g/mol.

$M_w$ is determined by size exclusion chromatography (SEC) using commercially available polymethylmethacrylate standards. The determination is affected by gel permeation chromatography with THF as eluent.

The term "(meth)acrylate" refers to both, esters of acrylic acid and esters of methacrylic acid. In accordance with the present invention, methacrylates are preferred.

The $C_{5-9}$-alkyl (meth)acrylates for use in accordance with the invention are esters of (meth)acrylic acid and straight-chained or branched alcohols having 5 to 9 carbon atoms. The term "$C_{5-9}$-alkyl (meth)acrylates" encompasses individual (meth)acrylic esters with an alcohol of a particular length, and likewise mixtures of methacrylic esters with alcohols of different lengths.

Suitable $C_{5-9}$-alkyl (meth)acrylates include, for example, pentyl (meth)acrylate, hexyl (meth)acrylate, heptyl (meth) acrylate, 2-ethylhexyl (meth)acrylate and nonyl (meth)acrylate.

The $C_{10-18}$ alkyl (meth)acrylates for use in accordance with the invention are esters of (meth)acrylic acid and straight chain or branched alcohols having 10 to 18 carbon atoms. The term "$C_{10-18}$ alkyl (meth)acrylates" encompasses individual (meth)acrylic esters with an alcohol of a particular length, and likewise mixtures of (meth)acrylic esters with alcohols of different lengths.

Suitable $C_{10-18}$ alkyl (meth)acrylates include, for example, decyl (meth)acrylate, undecyl (meth)acrylate, 5-methylundecyl (meth)acrylate, dodecyl (meth)acrylate, 2-methyldodecyl (meth)acrylate, tridecyl (meth)acrylate, 5-methyltridecyl (meth)acrylate, tetradecyl (meth)acrylate, pentadecyl (meth)acrylate, hexadecyl (meth)acrylate, heptadecyl (meth)acrylate and octadecyl (meth)acrylate.

The $C_{20-24}$ alkyl (meth)acrylates for use in accordance with the invention are esters of (meth)acrylic acid and straight-chained alcohols having 20 to 24 carbon atoms. The term "$C_{20-24}$ alkyl (meth)acrylates" encompasses individual (meth)acrylic esters with an alcohol of a particular length, and likewise mixtures of (meth)acrylic esters with alcohols of different lengths.

Suitable straight-chained $C_{20-24}$ alkyl (meth)acrylates include, for example, eicosyl (meth)acrylate and docosyl (meth)acrylate.

The dispersant monomers for use in accordance with the invention are selected from the group consisting of hydroxyethyl methacrylate, N,N-dimethylaminoethyl methacrylate (DMAEMA), N-(3-(dimethylamino)propyl)methacrylamide (DMAPMAm) and N-vinylpyrrolidinone (NVP).

For the synthesis of the polyalkyl(meth)acrylate-based viscosity index improver (i), the monomer mixtures described above can be polymerized by any known method. Conventional radical initiators can be used to perform a classic radical polymerization. These initiators are well known in the art. Examples for these radical initiators are azo initiators like 2,2'-azodiisobutyronitile (AIBN), 2,2'-azobis(2-methylbutyronitrile) and 1,1 azo-biscyclohexane carbonitrile; peroxide compounds, e.g. methyl ethyl ketone peroxide, acetyl acetone peroxide, dilauryl peroxide, tert.-butylper-2-ethyl hexanoate, ketone peroxide, methyl isobutyl ketone peroxide, cyclohexanone peroxide, dibenzoyl peroxide, tert.-butylper-benzoate, tert.-butylperoxy isopropyl carbonate, 2,5-bis(2-ethylhexanoyl-peroxy)-2,5-dimethyl hexane, tert.-butylperoxy 2-ethyl hexanoate, tert.-butylperoxy-3,5,5-trimethyl hexanoate, dicumene peroxide, 1,1 bis(tert.-butylperoxy) cyclohexane, 1,1 bis(tert.-butylperoxy) 3,3,5-trimethyl cyclohexane, cumene hydroperoxide and tert.-butyl hydroperoxide.

Poly(meth)acrylates with a lower molecular weight can be obtained by using chain transfer agents. This technology is ubiquitously known and practiced in the polymer industry and is de-scribed in Odian, Principles of Polymerization, 1991.

Furthermore, novel polymerization techniques such as ATRP (Atom Transfer Radical Polymerization) and or RAFT (Reversible Addition Fragmentation Chain Transfer) can be applied to obtain useful polymers derived from alkyl esters. These methods are well known. The ATRP reaction method is described, for example, by J-S. Wang, et al., J. Am. Chem. Soc., Vol. 117, pp. 5614-5615 (1995), and by Matyjaszewski, Macromolecules, Vol. 28, pp. 7901-7910 (1995). Moreover, the patent applications WO 96/30421, WO 97/47661, WO 97/18247, WO 98/40415 and WO 99/10387 disclose variations of the ATRP explained above to which reference is expressly made for purposes of the disclosure. The RAFT method is extensively presented in WO 98/01478, for example, to which reference is expressly made for purposes of the disclosure.

The polymerization can be carried out at normal pressure, reduced pressure or elevated pressure. The polymerization temperature is in the range of −20 to 200° C., preferably 60 to 120° C., without any limitation intended by this. The polymerization can be carried out with or without solvents. The term solvent is to be broadly understood here. According to a preferred embodiment, the polymer is obtainable by a polymerization in API Group I, II or III mineral oil or in API group IV synthetic oil.

The base oil to be used in the compressor oil comprises an oil of lubricating viscosity. Such oils include natural and synthetic oils, oils derived from hydrocracking, hydrogenation, and hydro-finishing, unrefined, refined, re-refined oils or mixtures thereof.

The base oil may also be defined as specified by the American Petroleum Institute (API) (see April 2008 version of "Appendix E-API Base Oil Interchangeability Guidelines for Passenger Car Motor Oils and Diesel Engine Oils", section 1.3 Subheading 1.3. "Base Stock Categories").

The API currently defines five groups of lubricant base stocks (API 1509, Annex E—API Base Oil Interchangeability Guidelines for Passenger Car Motor Oils and Diesel Engine Oils, September 2011). Groups I, II and III are mineral oils which are classified by the amount of saturates and sulphur they contain and by their viscosity indices; Group IV are polyalphaolefins; and Group V are all others, including e.g. ester oils. The table below illustrates these API classifications.

| Group | Saturates | Sulphur content | Viscosity Index (VI) |
|---|---|---|---|
| I | <90% | >0.03% | 80-120 |
| II | at least 90% | not more than 0.03% | 80-120 |
| II | at least 90% | not more than 0.03% | at least 120 |
| IV | Polyalphaolefins (PAOs) | | |
| V | All others not included in Groups I, II, III or IV (e.g. ester oils) | | |

The kinematic viscosity at 100° C. ($KV_{100}$) of appropriate apolar base oils used to prepare a compressor oil in accordance with the present invention is preferably in the range of 1 mm/s to 20 mm/s, more preferably in the range of 2 mm/s to 10 mm/s, determined to ASTM D445.

Particularly preferred compressor oils of the present invention comprise at least one base oil selected from the group consisting of API Group II oils, API Group III oils, polyalphaolefins (PAO) and mixtures thereof.

Further base oils which can be used in accordance with the present invention are Group II-III Fischer-Tropsch derived base oils.

Fischer-Tropsch derived base oils are known in the art. By the term "Fischer-Tropsch derived" is meant that a base oil is, or is derived from, a synthesis product of a Fischer-Tropsch process. A Fischer-Tropsch derived base oil may also be referred to as a GTL (Gas-To-Liquids) base oil. Suitable Fischer-Tropsch derived base oils that may be conveniently used as the base oil in the compressor oil of the present invention are those as for example disclosed in EP 0 776 959, EP 0 668 342, WO 97/21788, WO 00/15736, WO 00/14188, WO 00/14187, WO 00/14183, WO 00/14179, WO 00/08115, WO 99/41332, EP 1 029 029, WO 01/18156, WO 01/57166 and WO 2013/189951.

The compressor oil used according to the present invention may also contain one or more further additives selected from the group consisting of pour point depressants, dispersants, defoamers, detergents, demulsifiers, antioxidants, antiwear additives, extreme pressure additives, friction modifiers, anticorrosion additives, metal deactivators and metal passivators and mixtures thereof; preferably antiwear additives, anticorrosion additives and antioxidants.

The compressor oil used according to the present invention may preferably comprise up to 2.5% by weight, preferably 0.5% to 1.5% by weight, of a performance package containing at least an antiwear agent, an anticorrosion agent and an antioxidant.

The performance package is preferably a zinc-free performance package, more preferably fully ashless.

Preferred pour point depressants are, for example, selected from the group consisting of alkylated naphthalene and phenolic polymers, polyalkyl methacrylates, maleate copolymer esters and fumarate copolymer esters, which may conveniently be used as effective pour point depressants. The compressor oil may contain 0.1% by weight to 0.5% by weight of a pour point depressant. Preferably, not more than 0.3% by weight of a pour point depressant is used.

Appropriate dispersants include poly(isobutylene) derivatives, for example poly(isobutylene)succinimides (PIBSIs), including borated PIBSIs; and ethylene-propylene oligomers having N/O functionalities. The compressor oil may contain 0.05% to 5% by weight of at least one dispersant, based on the total weight of the compressor oil.

Suitable defoaming agents include, for example, silicone oils, fluorosilicone oils, and fluoroalkyl ethers. The compressor oil may contain 0.01% to 0.02% by weight of at least one defoaming agent, based on the total weight of the compressor oil.

The detergents include metal-containing compounds, for example phenoxides; salicylates; thiophosphonates, especially thiopyrophosphonates, thiophosphonates and phosphonates; sulfonates and carbonates. As metal, these compounds may contain especially calcium, magnesium and barium. These compounds may preferably be used in neutral or overbased form.

Preferred demulsifiers include alkyleneoxide copolymers and (meth)acrylates including polar functions.

The suitable antioxidants include, for example, phenols, for example 2,6-di-tert-butylphenol (2,6-DTB), 2,6-di-tert-butyl-4-ethylphenol, butylated hydroxytoluene (BHT), 2,6-di-tert-butyl-4-methylphenol, 4,4'-methylenebis(2,6-di-tert-butylphenol); aromatic amines, especially alkylated diphenylamines, N-phenyl-1-naphthylamine (PNA), N,N'-di-phenyl-p-phenylenediamine, polymeric 2,2,4-trimethyl-dihydroquinone (TMQ); "OOS triesters"=reaction products of dithiophosphoric acid with activated double bonds from olefins, cyclopentadiene, norbornadiene, α-pinene, polybutene, acrylic esters, maleic esters (ashless on combustion); organophosphorus compounds, for example triaryl and trialkyl phosphites; organocopper compounds and overbased calcium- and magnesium-based phenoxides and salicylates. The compressor oil may contain 0.05% to 5% by weight of at least one antioxidant, based on the total weight of the compressor oil.

The preferred antiwear and extreme pressure additives include phosphorus compounds, for example trialkyl phosphates, triaryl phosphates, e.g. tricresyl phosphate, amine-neutralized mono- and dialkyl phosphates, ethoxylated mono- and dialkyl phosphates, phosphites, phosphonates or phosphines. The compressor oil may contain 0.05% to 3% by weight of at least one antiwear and extreme pressure additive, based on the total weight of the compressor oil.

Examples of the metal deactivators include triazoles, thiadiazoles and salicylidenes, like e.g. N,N'-disalicylidene-1,2-diaminopropane.

Rust inhibitors are widely used. Common chemistries are carboxylates like succinic acid half esters, sulfonates, alkyl amines and phosphates, e.g. amine neutralized phosphate esters.

Friction modifiers used may include mechanically active compounds, for example molybdenum disulfide, graphite (including fluorinated graphite), poly(trifluoroethylene), polyamide, polyimide; compounds that form adsorption layers, for example long-chain carboxylic acids, fatty acid esters, ethers, alcohols, amines, amides, imides; compounds which form layers through tribochemical reactions, for example saturated fatty acids, phosphoric acid and thiophosphoric esters, xanthogenates, sulfurized fatty acids; compounds that form polymer-like layers, for example ethoxylated dicarboxylic partial esters, dialkyl phthalates, methacrylates, unsaturated fatty acids, and sulfurized olefins.

All components being part of the formulation need to show acceptable compatibility with the refrigerant over a wide range of operating temperatures.

The above-detailed additives are described in detail, inter alia, in T. Mang, W. Dresel (eds.): "Lubricants and Lubrication", Wiley-VCH, Weinheim 2001; R. M. Mortier, S. T. Orszulik (eds.): "Chemistry and Technology of Lubricants".

The total concentration of the one or more additives in a compressor oil is up to 5% by weight, preferably 0.1% to 4% by weight, more preferably 0.5% to 3% by weight, based on the total weight of the compressor oil.

A further object of the present invention is directed to the method of increasing the energy efficiency of a compressor as outlined further above, wherein the compressor is selected from the group consisting of household or domestic refrigeration units, air compressors and $CO_2$ compressors.

A further object of the present invention is directed to the method of increasing the energy efficiency of a compressor as outlined further above, wherein the compressor is part of a household or domestic refrigeration unit, the base oil (ii) is selected from API group IV or V oils and mixtures thereof and the compressor oil has a kinematic viscosity at 40° C. in the range of 2.88 and 7.48 cSt.

This range encompasses the ISO viscosity grades 3 to 7.

The refrigerant used in the household or domestic refrigeration unit may be isobutane or propane, preferably isobutane.

A further object of the present invention is directed to the method of increasing the energy efficiency of a household or domestic refrigeration unit using isobutane or propane, preferably isobutane, as refrigerant, comprising operating the refrigeration unit with a compressor oil, wherein the compressor oil comprises:

(i) 1 wt. % to 10 wt. % of a polyalkyl methacrylate-based viscosity index improver comprising:
  (a) 0.2 wt. % to 25 wt. %, preferably 4 wt. % to 16 wt. %, of methyl methacrylate; and
  (b) 75 wt. % to 99.8 wt. %, preferably 84 wt. % to 96 wt. %, of C10-18 alkyl (meth)acrylates, wherein the weight average molecular weight ($M_w$) of the polyalkyl (meth)acrylate-based viscosity index improver is in the range of 5,000 g/mol to 200,000 g/mol, preferably 10,000 g/mol to 200,000 g/mol;
(ii) 90 wt. % to 99 wt. % of the API group IV or V base oils and mixtures thereof; and
(iii) 0 wt. % to 2.5 wt. % of a zinc-free performance package comprising at least an antiwear agent, an anticorrosion agent and an antioxidant, wherein the compressor oil has a kinematic viscosity at 40° C. in the range of 2.88 and 7.48 cSt and a viscosity index of at least 140, preferably at least 160, more preferably at least 180.

In a further preferred object, the base oil (ii) is selected from naphthenic oils of API Group V and mixtures thereof being characterized by a $C_N$ value of at least 40%.

The content of each component (i), (ii) and (iii) is based on the total composition of the compressor oil. In a particular embodiment, the proportions of components (i), (ii) and (iii) add up to 100% by weight.

The content of each component (a) and (b) is based on the total composition of the polyalkyl (meth)acrylate-based viscosity index improver. The proportions of components (a) and (b) add up to 100% by weight.

A further object of the present invention is directed to the method of increasing the energy efficiency of a household or domestic refrigeration unit as outlined further above, wherein the compressor oil has a pour point of −60° C. or lower.

A further object of the present invention is directed to the method of increasing the energy efficiency of a compressor as outlined further above, wherein the compressor is an air compressor, the base oil (ii) is selected from API group II, III and IV or mixtures thereof and the compressor oil has a kinematic viscosity at 40° C. in the range of 28.8 and 74.8 cSt.

This range encompasses the ISO viscosity grades 32 to 68.

A further object of the present invention is directed to the method of increasing the energy efficiency of an air compressor, comprising operating the air compressor with a compressor oil, wherein the compressor oil comprises:

(i) 1 wt. % to 20 wt. % of a polyalkyl methacrylate-based viscosity index improver comprising:
  (a) 0.2 wt. % to 25 wt. % of methyl methacrylate;
  (b) 75 wt. % to 99.8 wt. % of C10-18 alkyl (meth) acrylates; and
  (c) 0 wt. % to 2 wt. % of straight-chained or branched C5-9 alkyl (meth)acrylates or straight-chained or branched C20-24 alkyl (meth)acrylates, wherein
  the weight average molecular weight ($M_w$) of the polyalkyl (meth)acrylate-based viscosity index improver is in the range of 5,000 g/mol to 400,000 g/mol, preferably in the range of 5,000 g/mol to 200,000 g/mol and more preferably in the range of 10,000 g/mol to 80,000 g/mol;
(ii) 80 wt. % to 99 wt. % of API group II, III or IV base oils or mixtures thereof; and
(iii) 0 wt. % to 2.5 wt. % of a zinc-free performance package comprising at least an antiwear agent, an anticorrosion agent and an antioxidant, wherein the compressor oil has a kinematic viscosity at 40° C. in the range of 28.8 and 74.8 cSt and a viscosity index of at least 140, preferably at least 160, more preferably at least 180.

The content of each component (i), (ii) and (iii) is based on the total composition of the compressor oil. In a particular embodiment, the proportions of components (i), (ii) and (iii) add up to 100% by weight.

The content of each component (a), (b) and (c) is based on the total composition of the polyalkyl (meth)acrylate-based viscosity index improver. The proportions of components (a), (b) and (c) add up to 100% by weight.

A further object of the present invention is directed to the method of increasing the energy efficiency of an air compressor as outlined further above, wherein the polyalkylmethacrylate based VI improver further comprises (c) up to 5 wt. % of a dispersant monomer selected from the group consisting of hydroxyethyl methacrylate, N,N-dimethylaminoethyl methacrylate (DMAEMA), N-(3-(dimethylamino) propyl)methacrylamide (DMAPMAm) and N-vinylpyrrolidone (NVP).

Typical compressed air systems work at pressures of at least 5 bar or at higher pressures when high forces are required. Some blow molding applications are even operated at air pressures of 40 bar.

The effect of the inventive compressor oil on compressor performance is stronger at high gas pressures.

Preferably, the air compressor is run at an air pressure of at least 5 bar, more preferably at least 7 bar, and more preferably at least 9 bar.

A further object of the present invention is directed to the method of increasing the energy efficiency of a compressor as outlined further above, wherein the compressor is a carbon dioxide compressor, the base oil (i) is selected from API group III, IV or V and mixtures thereof and the compressor oil has a kinematic viscosity at 40° C. in the rage of 41.4 and 110 cSt.

This range encompasses the ISO viscosity grades 46 to 100.

A further object of the present invention is directed to the method of increasing the energy efficiency of a carbon dioxide compressor, comprising operating the carbon dioxide compressor with a compressor oil, wherein the compressor oil comprises:

(i) 1 wt. % to 20 wt. % of a polyalkyl methacrylate-based viscosity index improver comprising:
  (a) 0.2 wt. % to 25 wt. %, preferably 4 wt. % to 16 wt. %, of methyl methacrylate; and
  (b) 75 wt. % to 99.8 wt. %, preferably 84 wt. % to 96 wt. %, of C10-18 alkyl (meth)acrylates, wherein the weight average molecular weight ($M_w$) of the polyalkyl (meth)acrylate-based viscosity index improver is in the range of 5,000 g/mol to 100,000 g/mol, preferably 30,000 g/mol to 100,000 g/mol;
(ii) 80 wt. % to 95 wt. % of a polyolester base oil or mixtures of different polyester base oils; and
(iii) 0 wt. % to 2.5 wt. % of a zinc-free performance package comprising at least an antiwear agent, an anticorrosion agent and an antioxidant, wherein the compressor oil has a kinematic viscosity at 40° C. in the range of 41.4 and 110 cSt and a viscosity index of at least 140, preferably at least 160, more preferably at least 180.

The content of each component (i), (ii) and (iii) is based on the total composition of the compressor oil. In a particular embodiment, the proportions of components (i), (ii) and (iii) add up to 100% by weight.

The content of each component (a) and (b) is based on the total composition of the polyalkyl (meth)acrylate-based viscosity index improver. The proportions of components (a) and (b) add up to 100% by weight.

The compressor oils commonly used in the carbon dioxide compressors is typically based on polyolester with a viscosity of 68 cSt at 40° C.

Commercially available Fuchs Reniso® C oils based on polyolesters are available with $KV_{40}$ of 55, 80 and 178 cSt. Viscosity indices are always well below 150.

A further object of the present invention is directed to the method of increasing the energy efficiency of a carbon dioxide compressor, comprising operating the carbon dioxide compressor with a compressor oil, wherein the compressor oil comprises:

(i) 1 wt. % to 30 wt. % of a polyalkyl methacrylate-based viscosity index improver comprising:
  (a) 0.2 wt. % to 25 wt. %, preferably 4 wt. % to 16 wt. %, of methyl methacrylate; and
  (b) 75 wt. % to 99.8 wt. %, preferably 84 wt. % to 96 wt. %, of C10-18 alkyl (meth)acrylates, wherein the weight average molecular weight ($M_w$) of the polyalkyl (meth)acrylate-based viscosity index improver is in the range of 5,000 g/mol to 100,000 g/mol, preferably 10,000 g/mol to 80,000 g/mol;
(ii) 80 wt. % to 99 wt. % of a polyalphaolefin base oil or mixtures of different polyalphaolefin base oils; and
(iii) 0 wt. % to 2.5 wt. % of a zinc-free performance package comprising at least an antiwear agent, an anticorrosion agent and an antioxidant, wherein the compressor oil has a kinematic viscosity at 40° C. in the range of 41.4 and 110 cSt and a viscosity index of at least 140, preferably at least 160, more preferably at least 180.

The content of each component (i), (ii) and (iii) is based on the total composition of the compressor oil. In a particular embodiment, the proportions of components (i), (ii) and (iii) add up to 100% by weight.

The content of each component (a) and (b) is based on the total composition of the polyalkyl (meth)acrylate-based viscosity index improver. The proportions of components (a) and (b) add up to 100% by weight.

A further object of the present invention is directed to the method of increasing the energy efficiency of a carbon dioxide compressor, comprising operating the carbon dioxide compressor with a compressor oil, wherein the compressor oil comprises:

(i) 1 wt. % to 30 wt. % of a polyalkyl methacrylate-based viscosity index improver comprising:
  (a) 0 wt. % to 25 wt. % of methyl methacrylate;
  (b) 60 wt. % to 99.8 wt. % of C10-18 alkyl (meth) acrylates; and
  (c) 0 wt. % to 40 wt. % of C8-12 alpha-olefins, wherein the weight average molecular weight ($M_w$) of the polyalkyl (meth)acrylate-based viscosity index improver is in the range of 5,000 to 100,000 g/mol;
(ii) 70 wt. % to 99 wt. % of a polyalphaolefin base oil or mixtures of different polyalphaolefin base oils; and
(iii) 0 wt. % to 2.5 wt. % of a zinc-free performance package comprising at least an antiwear agent, an anticorrosion agent and an antioxidant, wherein the compressor oil has a kinematic viscosity at 40° C. in the range of 41.4 and 110 cSt and a viscosity index of at least 140, preferably at least 150, more preferably at least 160.

The content of each component (i), (ii) and (iii) is based on the total composition of the compressor oil. In a particular embodiment, the proportions of components (i), (ii) and (iii) add up to 100% by weight.

The content of each component (a), (b) and (c) is based on the total composition of the polyalkyl (meth)acrylate-based viscosity index improver. The proportions of components (a), (b) and (c) add up to 100% by weight.

The compressor oils commonly used in air compressors is typically based on API group I, II or III oil with a viscosity of 46 cSt at 40° C. and a viscosity index below 140. Oils are available from all major oil and compressor OEM's, e.g. Kaeser Sigma Fluid MOL with a $KV_{40}$ of 46 cSt and a VI of 106.

The pour point of that fluid is at −30° C.

A further object of the present invention is directed to the method of increasing the energy efficiency of an air compressor as outlined further above, wherein the compressor oil has a pour point of −33° C. or lower.

The FIGURE illustrates the test settings used to determine the effects on energy consumption in an air compressor.

The invention is further illustrated by the following non-limiting examples and comparative example (reference oil). The examples below serve for further explanation of preferred embodiments according to the present invention but are not intended to restrict the invention.

EXPERIMENTAL PART

Abbreviations

Synesstic®5 alkylated naphthalene base oil from ExxonMobil with a $KV_{40}$ of 29 cSt Berylane® 230 naphthenic base oil from Total with a $KV_{40}$ of 2.3 cSt and a CN value of about 45%

KV kinematic viscosity measured according to ASTM D445

$KV_{40}$ kinematic viscosity measured @40° C. to ASTM D445

$KV_{100}$ kinematic viscosity measured @100° C. to ASTM D445

$M_n$ number-average molecular weight $M_w$ weight-average molecular weight

NS3 naphthenic base oil from Nynas with a $KV_{40}$ of 2.9 cSt and a $C_N$ value of about 57%

PAO6 Group IV base oil with a $KV_{100}$ of 6 cSt

PAO8 Group IV base oil with a $KV_{100}$ of 8 cSt

PDI polydispersity index

PP pour point

T3 naphthenic base oil from Nynas with a $KV_{40}$ of 3.6 cSt and a $C_N$ value of about 52%

T9 naphthenic base oil from Nynas with a $KV_{40}$ of 9.1 cSt and a $C_N$ value of about 45%

VI viscosity index

Test Methods

The polyalkyl methacrylate-based polymers according to the present invention were characterized with respect to their weight-average molecular weight.

The compressor oils including the polyalkyl methacrylate-based polymers according to the present invention and the comparative examples were characterized with respect to their kinematic viscosity at 40° C. ($KV_{40}$) and 100° C. ($KV_{100}$) to ASTM D445, their viscosity index (VI) to ASTM D2270, their pour point to ASTM D5950, their flash point ASTM D92 and their viscosity shear loss.

Determination of effects on energy consumption in a household or domestic refrigeration unit A standardized performance test rig measured the power consumption of the compressor at specified rating conditions. It allowed to ensure the same operating conditions for a number of tests. Furthermore, the performance test comprised the calculation of the coefficient of performance (COP; corresponding to the ratio of cooling power to electric drive power) at the specified rating conditions and the volumetric efficiency, the ratio of real volume flow to geometrically possible volume flow. The latter indicated the sealing properties of the working chamber of the compressor.

The test-rig setup was designed for performance tests of small capacity refrigerant-compressors in accordance with the ASHRAE standard 23.1 (2010), resp. DIN EN 13771-1 (2017). Based on a standard vapor compression cycle, the test bench included a calorimeter evaporator and a flow meter to determine the refrigerant mass flow rate. Besides the main components like the compressor, the condenser, and an electronic expansion device, the cycle was additionally equipped with an oil separator, a filter dryer, sight glasses, and an accumulator.

The compressor was a hermetic reciprocating piston compressor of type Embraco VEMX 7C, refrigerant was R600a (isobutane). The compressor was operated at three speeds: 50 Hz, 100 Hz and 150 Hz. CECOMAF (Comité européen des constructeurs de matériel frigorifique) conditions were applied: gas temperature on suction side=32° C., dew point on suction side=−25° C., dew point on pressure side=+55° C., ambient temperature=35+−2° C.

The general processing of the acquired data for this experimental investigation followed the European standard on compressor rating (DIN EN 13771-1, 2017).

TABLE 1

Formulations and results retrieved with inventive and comparative refrigeration compressor oils.

| Composition | CE 1 | Ex 1 | Ex 2 | Ex 3 | CE 2 |
|---|---|---|---|---|---|
| Polymer 1 [wt. %] | | 3.40 | 2.60 | 6.20 | |
| Performance package*) [wt. %] | | 0.8 | 0.8 | 0.8 | 0.8 |
| Nynas T3 [wt. %] | | | 96.60 | 93.00 | 32.40 |
| Nynas NS3 [wt. %] | | 95.80 | | | |
| Nynas T9 [wt. %] | | | | | 66.80 |
| Genuine oil, Alkyl benzene based [wt. %] | 100 | | | | |
| Total [%] | 100 | 100 | 100 | 100 | 100 |
| $KV_{40}$ [$mm^2/s$] | 4.90 | 4.12 | 4.94 | 7.08 | 7.08 |
| ISO VG | 5 | "4"**) | 5 | 7 | 7 |
| $KV_{100}$ [$mm^2/s$ | 1.59 | 1.63 | 1.79 | 2.55 | 1.99 |
| VI | 64 | 240 | 164 | 238 | 58 |
| PP [° C.] | −57 | −87 | −81 | −78 | −69 |
| Shear loss ASTM D5621 [%] | | 7.3 | 6.2 | 11 | |
| Efficiency (COP) at 50 Hz [%] | 1.26 | | 1.39 | | |
| Efficiency (COP) at 100 Hz [%] | 1.42 | | 1.47 | | |
| Efficiency (COP) at 150 Hz [%] | 1.33 | | 1.37 | | |
| Volumetric Efficiency at 50 Hz | 62 | | 65 | | |
| Volumetric Efficiency at 100 Hz | 61 | | 64 | | |
| Volumetric Efficiency at 150 Hz | 59.8 | | 61.3 | | |

*)As performance package, a commercially available zinc-free performance package comprising at least an antiwear agent, an anticorrosion agent and an antioxidant was used to protect the compressor.

**)The value of KV 40 = 4.12 $mm^2/s$ is slightly below the defined range for ISO VG 5; an ISO VG 4 is not defined.

Polymer 1 consists of 13 wt. % of methyl methacrylate, 86.5 wt. % of C10-16 alkyl methacrylates and 0.5 wt. % of C11-18 alkyl methacrylates (Mw=77,000 g/mol, 80% solids dissolved in highly refined mineral oil).

As Comparative Example 1 (CE 1) was used a commercially available alkyl benzene based oil having a $KV_{40}$ of 4.90 $mm^2/s$ (corresponding to ISO VG 5). Comparative Example 2 (CE 2) is a mixture of different naphthenic base oils, having a $KV_{40}$ of about 7 (corresponding to ISO VG 7). The comparative examples do not contain any polyalkyl (meth)acrylate.

Working examples 1-3 (Ex 1-3) are also based on naphthenic base oils and Polymer 1 as a polyalkyl (meth)acrylate. Ex 1-3 are formulated to a $KV_{40}$ of 4 mm/s (Ex 1), 5 mm/s (Ex 2) and 7 mm/s (Ex 3), corresponding to ISO "VG 4", VG 5 and VG 7, respectively.

Conclusions

The inventive oil has shown an improvement of the volumetric efficiency and the coefficient of performance at all driving speeds (50/100/150 Hz). The compressor oils with high VI show good compatibility (no detrimental separation and accumulation was observed) with the refrigerant and allow an improvement of equipment performance.

Determination of Effects on Energy Efficiency in Air Compressors

Another aspect of the invention was the improvement of air compressor efficiency.

Compressor oils with VI 140 and higher were tested in a Kaeser SX4 screw compressor and were compared with the commercially used mineral oil-based monograde fluid of Kaeser having a VI of 106.

A second air compressor of larger size was used to determine energy efficiency benefits, Atlas Copco GA75VSD.

The test settings used are described in the FIGURE.

Characterization of air compressors as used in relevant test procedures:

| (1) KAESER SX4 | |
|---|---|
| Date of Manufacture: | 2019 September |
| Manufacturer: | Kaeser |
| Compression Medium: | Air |
| Reference Frequency: | 50 Hz |
| Maximum Air Volume Flow Rate: | 0.36 $m^3$/min |
| Presurre Stages: | 1 |
| Maximum discharge pressure: | 11 bar |
| Motor Capacity: | 3.0 kW |
| (2) Atlas Copco GA75VSD P A 13 MK5 | |
| Date of Manufacture: | 2019 January |
| Manufacturer: | Atlas Copco |
| Compression Medium: | Air |
| Reference Frequency/ Lower limit Frequency: | 73/20 Hz |
| Maximum Air Volume Flow Rate: | 14.76 $m^3$/min |
| Presurre Stages: | 1 |
| Maximum discharge pressure: | 13 bar |
| Motor Capacity: | 75 kW |

The following parameters were measured: oil sump temperature, air temperature at the suction and discharge side, ambient air temperature, pressure and humidity; air pressure on suction and discharge side, air flow rate, and the power demand of the equipment. On the discharge side, a condensation air dryer was used to maintain dry air with less than 0.1% water in the compressed air.

Stationary operating conditions with two different oil temperatures and four different air pressures were adjusted. Air flow rates and power demand resulted in specific power demand values in W/(bar*L/min).

The following Table 2 shows the formulations and results retrieved with inventive and comparative air compressor oils.

TABLE 2

Formulations and results retrieved with inventive and comparative air compressor oils (AirEx and AirCE).

| Composition | AirCE 1 | AirEx 1 | AirEx 2 | AirEx 3 | AirEx 4 | AirEx 5 | AirEx 6 |
|---|---|---|---|---|---|---|---|
| Polymer 2 [wt. %] | 0 | 0 | 0 | 9.5 | 13.6 | 0 | 11.8 |
| Polymer 3 [wt. %] | 0 | 0 | 0 | 0 | 0 | 5.0 | 0 |
| Polymer 4 [wt. %] | 0 | 1.0 | 10.5 | 0 | 0 | 0 | 0 |
| Performance package*) [wt. %] | | 0.8 | 1.5 | 0.8 | 0.8 | 0.8 | 0.8 |
| PAO6 [wt. %] | | 10.0 | | | | | |
| PAO8 [wt. %] | | 89.0 | | | | | |
| Kaeser genuine fluid [wt. %] | 100 | | | | | | |
| Group III oil with $KV_{40}$ of about 4 $mm^2$/s [wt. %] | | | | 29.3 | 54.2 | | **) |
| Group III oil with $KV_{40}$ of about 6 $mm^2$/s [wt. %] | | | 88.0 | 60.4 | 31.4 | 94.2 | **) |
| Synesstic ®5 [%] | | | | | | | 6.0 |
| Total [%] | 100 | 100 | 100 | 100 | 100 | 100 | 100 |
| $KV_{40}$ [$mm^2$/s] | 46.0 | 45.99 | 46.27 | 45.96 | 46.81 | 46.34 | 55.0 |
| ISO VG | 46 | 46 | 46 | 46 | 46 | 46 | |
| $KV_{100}$ [wt. %] | 6.92 | 7.83 | 8.17 | 9.0 | 9.73 | 9.66 | 10.3 |
| VI | 106 | 140 | 151 | 181 | 200 | 200 | 180 |
| PP [° C.] | −30 | −54 | −45 | −45 | −45 | −45 | −42 |
| Shear loss at 100° C., ASTM D5621 [%] | <1 | <1 | <1 | 4.8 | 6.4 | >20 | 5.8 |

*)As performance package, a commercially available zinc-free performance package comprising at least an antiwear agent, an anticorrosion agent and an antioxidant was used to protect the compressor.
**) mixture of Group III oils adding up to 81.4% by weight Polymer 2 consists of 13 wt. % of methyl methacrylate and 87 wt. % of C10-16 alkyl methacrylates ($M_w$=56,000 g/mol, 74% solids dissolved in highly refined mineral oil).

Polymer 3 consists of 11.3 wt. % of methyl methacrylate, 88.3 wt. % of C10-18 alkyl methacrylates and 0.4 wt. % of C20-22 alkyl methacrylates ($M_w$=375,000 g/mol; 42% solids dissolved in highly refined mineral oil).

Polymer 4 consists of 0.2 wt. % of methyl methacrylate and 99.8 wt. % of iso C12-15 alkyl methacrylates ($M_w$=13,800 g/mol).

As comparative example 1 (AirCE 1) was used a genuine fluid (commercially available from Kaeser) having a $KV_{40}$ of 48 $mm^2$/s (corresponding to ISO VG 46). It does not contain any polyalkyl (meth)acrylate.

Working examples 1-6 (AirEx 1-6) arm based on different Group III base oils and contain a polyalkyl (meth)acrylate. AirEx 1-5 were formulated to a $KV_{40}$ of about 48 $mm^2$/s, corresponding to ISO VG 48; AirEx 6 was formulated to a $KV_{40}$ of about 55 $mm^2$/s.

The effects on energy consumption in an air compressor were received by using the compressor oils according to the present invention are summarized in the following Tables 3a, 3b and 3c.

TABLE 3a

Effects on energy consumption and efficiency in an air compressor by using compressor oils according to the present invention at an air pressure $p_{air}$ in the range of 8.39 to 9.43 bar.

| Ex # | $p_{Air}$ [bar] | $T_{Oil}$ [° C.] | $P_{Total}$ [W] | $T_{Air}$ outlet [° C.] | Air flow rate [L/min] | $P_{specific}$ ([W*min)/L] | Power ratio [(W*min)/(bar*L)] | Efficiency improvement [%] |
|---|---|---|---|---|---|---|---|---|
| AirCE 1 | 8.39 | 91.9 | 3111 | 70 | 294.5 | 10.56 | 1.26 | — |
| | 9.11 | 73.4 | 3242 | 59 | 310.5 | 10.44 | 1.15 | — |
| AirEx 4 | 8.85 | 93.7 | 3226 | 70 | 307.8 | 10.48 | 1.18 | 4.3 |
| | 9.43 | 74.9 | 3321 | 60 | 320.5 | 10.36 | 1.10 | 2.9 |
| AirEx 5 | 8.85 | 92.7 | 3215 | 70 | 298.6 | 10.77 | 1.22 | 1.5 |
| | 9.39 | 75.0 | 3310 | 60 | 314.6 | 10.52 | 1.12 | 1.0 |

TABLE 3b

Effects on energy consumption and efficiency in an air compressor by using compressor oils according to the present invention at an air pressure $p_{air}$ in the range of 7.06 to 7.67 bar.

| Ex # | $p_{Air}$ [bar] | $T_{Oil}$ [° C.] | $P_{Total}$ [M] | $T_{Air}$ outlet [° C.] | Air flow rate [L/min] | $P_{specific}$ [(W*min)/L] | Power ratio [(W*min/(bar*L)] | Efficiency improvement [%] |
|---|---|---|---|---|---|---|---|---|
| AirCE 1 | 7.06 | 87.9 | 2872 | 67 | 304.8 | 9.42 | 1.34 | — |
| | 7.44 | 70.7 | 2949 | 57 | 318.4 | 9.26 | 1.25 | — |
| AirEx 4 | 7.27 | 89.0 | 2948 | 68 | 318.2 | 9.26 | 1.27 | 3.9 |
| | 7.67 | 70.7 | 3013 | 58 | 329.7 | 9.14 | 1.19 | 3.4 |
| AirEx 5 | 7.22 | 87.8 | 2926 | 67 | 309.6 | 9.45 | 1.31 | 1.3 |
| | 7.63 | 70.7 | 3003 | 57 | 325.1 | 9.24 | 1.21 | 2.0 |

TABLE 3c

Effects on energy consumption and efficiency in an air compressor by using compressor oils according to the present invention at an air pressure $p_{air}$ in the range of of 4.89 to 5.15 bar.

| Ex # | $p_{Air}$ [bar] | $T_{Oil}$ [° C.] | $P_{Total}$ [W] | $T_{Air}$ outlet [° C.] | Air flow rate [L/min] | $P_{specific}$ [(W*min)/L] | Power ratio [(W*min)/(bar*L)] | Efficiency improvement [%] |
|---|---|---|---|---|---|---|---|---|
| AirCE 1 | 4.89 | 81.2 | 2539 | 63 | 318.1 | 7.98 | 1.63 | — |
| | 5.04 | 68.1 | 2585 | 55 | 328.6 | 7.87 | 1.56 | — |
| AirEx 4 | 5.00 | 81.1 | 2596 | 63 | 331.3 | 7.84 | 1.57 | 3.4 |
| | 5.15 | 68.3 | 2613 | 55 | 337.1 | 7.75 | 1.51 | 3.0 |
| AirEx 5 | 4.92 | 80.6 | 2559 | 63 | 322.5 | 7.93 | 1.61 | 0.8 |
| | 5.15 | 68.4 | 2613 | 55 | 334.2 | 7.82 | 1.52 | 2.2 |

$p_{Air}$: air pressure at air discharge
$T_{Oil}$: Compressor oil temperature
$P_{total}$: total power demand of compressor
Air flow rate: air flow at air discharge side (dry air at pair)
$P_{specific}$: power demand of compressor unit divided by air flow rate
Power ratio: power demand of compressor unit divided by (air flow rate × air discharge pressure)

The efficiency improvement was calculated from $P_{specific}$, suction pressures and the individual compression ratios at test conditions vs reference conditions (correction factor):

$$\Delta\ \text{Efficiency}_{relative} = \frac{\eta_2}{\eta_1} - 1 = \frac{P_{specific,1}}{P_{specific,2}} \times \frac{p_{suction,2}}{p_{suction,1}} \times \text{correction} - 1$$

Additional tests were run on Atlas Copco GA75VSD. The oil temperature was controlled to 90° C. Three different discharge air pressures were investigated at 8 bar, 10 bar and 12.5 bar.

The following Table 4 shows the results retrieved with using Atlas Copco GA75VSD.

TABLE 4 results retrieved with using Atlas Copco GA75VSD

| Fluid | VG | VI | KV90 [cSt] | $T_{Oil}$ [° C.] | $P_{air, out}$ [bar] | $P_{specific}$ [W*min/L] | rel. efficiency improvement [%] |
|---|---|---|---|---|---|---|---|
| mineral-based | 46 | 105 | 8.69 | 90 | 8 | 7.11 | — |
| VG46 - | | | | 90 | 10 | 7.92 | — |
| Reference | | | | 90 | 12.5 | 9.11 | — |
| AirEx3 | 46 | 180 | 11.05 | 90 | 8 | 6.99 | 1.7 |
| | | | | 90 | 10 | 7.77 | 1.9 |
| | | | | 90 | 12.5 | 8.91 | 2.2 |
| AirEx6 | 55 | 180 | 12.55 | 90 | 8 | 7.00 | 1.6 |
| | | | | 90 | 10 | 7.75 | 2.2 |
| | | | | 90 | 12.5 | 8.87 | 2.7 |

TABLE 5

Shear loss of oils during test procedure after 1 day testing at various conditions:

| Fluid | VI | KV40 (cSt) Fresh oil | KV100 (cSt) | VI | KV40 (cSt) | KV100 (cSt) After test | AVI (%) | AKV40 (%) |
|---|---|---|---|---|---|---|---|---|
| AirCE1 | 106 | 46.1 | 6.9 | 106 | 46.2 | 6.9 | 0 | +0.2 |
| AirEx3 | 181 | 45.9 | 9.0 | 181 | 45.9 | 9.0 | 0 | 0 |
| AirEx4 | 200 | 46.8 | 9.7 | 198 | 46.7 | 9.7 | −1 | −0.2 |
| AirEx5 | 200 | 46.3 | 9.7 | 177 | 40.6 | 8.1 | −11.5 | −12.4 |

Conclusions:

The electric power demand was measured for at least 15 minutes after stationary operating conditions were achieved at various discharge pressures and oil temperatures.

The power ratio was defined by the ratio of the measured electric power demand and the output power, measured in air volume flow rate in liter per minute multiplied by the pressure at the compressor air discharge side. Constant and repeatable ambient conditions were achieved by operating the equipment in a controlled air-conditioned room.

The investigations on the air compressor test rigs have clearly shown an efficiency advantage of compressor oils with a VI of at least 140 and high shear stability. The efficiency was significantly improved at all investigated operating conditions. At oil temperatures of about 75° C., a reduction of the power ratio from 1.15 (W*min)/(bar*L) to 1.10 (W*min)/(bar*L) was achieved with changing the compressor oil from AirCE1 to AirEx4, the fluid comprising Polymer 2 and having a VI of 200. At an oil temperature of 92 to 94° C., an even stronger improvement from 1.26 (W*min)/(bar*L) of AirCE1 to 1.18 (W*min)/(bar*L) of AirEx4 was observed. The corresponding efficiency improvement was calculated to 4.3%. The fluid AirEx5 comprising Polymer 3 and having a VI of 200 also allowed to increase the efficiency. The improvement at oil temperatures above 90° C. and an air discharge pressure of about 9 bar was about 1.5%. The molecular weight of the polymer used in AirEx5 was higher and the shear stability of the oil was lower compared to compressor oil AirEx4. A higher shear stability is advantageous for the efficiency improvement and for the lifetime of the oil. The inventive fluids had a maximum $KV_{100}$ shear loss of 40% in the 40 minutes sonic shear test method according to ASTM D5621. Preferred is a lower shear loss of maximum 20% and more preferred a shear loss of less than 10% according to ASTM D5621.

Table 5 shows the viscosities of oils before and after the testing on the compressor test rigs. Viscosities of AirEx3 and AirEx4 have not changed over time of the test duration, however, the viscosity of oil AirEx5 with Polymer 3 dropped down by more than 10% under real life conditions. The molecular weight of polymer 3 is relatively high and shear stability is not good enough for a long-term efficiency improvement of air compressors.

The pour point of the compressor fluids according to the present invention were −33° C. or lower. High VI, low pour point and high shear stability were achieved by blending Group II, Group III or PAO base oils with the polyalkyl methacrylate-based viscosity index improvers according to the present invention having a defined composition and a maximum molecular weight of 400,000 g/mol, preferably below 200,000 g/mol and more preferably below 100,000 g/mol. It was recognized that the equipment can be operated at lower temperatures with higher VI and more shear stable lubricants. When using more efficient fluids it became necessary to block the cooling units to achieve higher oil operating temperature levels of 90° C. as requested for the test runs. The investigations have shown that overheating can be avoided by using compressor oils according to the present invention, as a more efficient air compressor has the tendency to run at lower temperatures.

The invention claimed is:

1. A method of increasing the energy efficiency of an air compressor, the method comprising:

operating the air compressor with a compressor oil, wherein the compressor oil comprises:

(i) 1 wt. % to 30 wt. % of a polyalkyl methacrylate-based viscosity index improver consisting of:

(a) 0 wt. % to 25 wt. % of methyl methacrylate;

(b) 75 wt. % to 100 wt. % of at least one straight-chained or branched C10-18 alkyl (meth)acrylate; and (c) 0 wt. % to 2 wt. % of at least one straight-chained or branched C5-9 alkyl (meth)acrylate or at least one straight-chained or branched C20-24 alkyl (meth) acrylate, wherein a weight average molecular weight (Mw) of the polyalkyl (meth)acrylate-based viscosity index improver is in a range of 5,000 g/mol to 400,000 g/mol;

(ii) 70 wt. % to 99 wt. % of a base oil, wherein the base oil is an oil of American Petroleum Institute (API) group II, III, IV, or V, or a mixture thereof; and (iii) optionally, up to 2.5 wt. % of a performance package comprising one or more further additives, wherein the compressor oil has a viscosity index of at least 140.

2. The method according to claim 1, wherein the polyalkyl methacrylate-based viscosity index improver consists of:

(a) 0.2 wt. % to 25 wt. % of the methyl methacrylate;

(b) 75 wt. % to 99.8 wt. % of the at least one C10-18 alkyl (meth)acrylate; and (c) 0 wt. % to 2 wt. % of the at least one straight-chained or branched C5-9 alkyl (meth)acrylate or the at least one straight-chained or branched C20-24 alkyl (meth) acrylate.

3. The method according to claim 1, wherein the weight average molecular weight (Mw) of the polyalkyl (meth) acrylate-based viscosity index improver is in a range of 5,000 g/mol to 200,000 g/mol.

4. The method according to claim 1, wherein the performance package (iii) comprises at least an antiwear agent, an anticorrosion agent, and an antioxidant.

5. The method according to claim 1, wherein the base oil (ii) is an API group II, III, or IV oil, or a mixture thereof, and the compressor oil has a kinematic viscosity at 40° C. in a range of 28.8 and 74.8 cSt.

6. The method according to claim 1, comprising:

operating the air compressor with the compressor oil, wherein the compressor oil comprises:

(i) 1 wt. % to 20 wt. % of the polyalkyl methacrylate-based viscosity index improver consisting of:

(a) 0.2 wt. % to 25 wt. % of the methyl methacrylate;

(b) 75 wt. % to 99.8 wt. % of the at least one C10-18 alkyl (meth)acrylate; and (c) 0 wt % to 2 wt. % of the at least one straight-chained or branched C5-9 alkyl (meth)acrylate or the at least one straight-chained or branched C20-24 alkyl (meth)acrylate, wherein the weight average molecular weight (Mw) of the polyalkyl (meth)acrylate-based viscosity index improver is in the range of 5,000 to 400,000 g/mol;

(ii) 80 wt. % to 99 wt. % of an API group II, III, or IV base oil, or a mixture thereof; and (iii) 0 wt. % to 2.5 wt. % of a zinc-free performance package comprising at least an antiwear agent, an anticorrosion agent, and an antioxidant, wherein the compressor oil has a kinematic viscosity at 40° C. in the range of 28.8 and 74.8 cSt and a viscosity index of at least 140.

7. The method according to claim 5, wherein the compressor oil has a pour point of −33° C. or lower.

8. The method according to claim 1, wherein the compressor oil has a viscosity index of at least 180.

9. The method according to claim 2, wherein the polyalkyl methacrylate-based viscosity index improver consists of:

(a) 4 wt. % to 16 wt. % of the methyl methacrylate;

(b) 84 wt. % to 96 wt. % of the at least one C10-18 alkyl methacrylate; and (c) 0 wt. % to 2 wt. % of the at least one straight-chained or branched C5-9 alkyl (meth)acrylate or the at least one straight-chained or branched C20-24 alkyl (meth) acrylate.

10. The method according to claim 4, wherein the performance package (iii) is zinc-free.

11. The method according to claim 4, wherein the performance package (iii) is ashless.

12. The method according to claim 1, wherein the compressor oil comprises:

(i) 1 wt. % to 20 wt of the polyalkyl methacrylate-based viscosity index improver;

(ii) 80 wt. % to 99 wt. % of the base oil; and (iii) 0 wt. % to 2.5 wt. % of a zinc-free performance package comprising at least an antiwear agent, an anticorrosion agent and an antioxidant.

13. The method according to claim 1, wherein the compressor oil comprises:

(i) 1 wt. % to 15 wt. % of the polyalkyl methacrylate-based viscosity index improver;

(ii) 85 wt. % to 99 wt. % of the base oil; and (iii) 0 wt. % to 2.5 wt. % of a zinc-free performance package comprising at least an antiwear agent, an anticorrosion agent and an antioxidant.

14. The method according to claim 1, wherein the compressor oil comprises:

(i) 1 wt. % to 10 wt. % of the polyalkyl methacrylate-based viscosity index improver;

(ii) 90 wt. % to 99 wt. % of the base oil; and (iii) 0 wt. % to 2.5 wt. % of a zinc-free performance package comprising at least an antiwear agent, an anticorrosion agent and an antioxidant.

* * * * *